United States Patent [19]

Lait

[11] Patent Number: 4,760,400

[45] Date of Patent: Jul. 26, 1988

[54] SANDWICH-WIRE ANTENNA

[75] Inventor: Andrew J. Lait, Kanata, Canada

[73] Assignee: Canadian Marconi Company, Montreal, Canada

[21] Appl. No.: 885,954

[22] Filed: Jul. 15, 1986

[51] Int. Cl.[4] ..... H01Q 10/38

[52] U.S. Cl. ..... 343/700 MS; 343/830; 343/860; 343/864; 333/35

[58] Field of Search ..... 343/700 MS, 782, 820, 343/830, 860, 864; 333/33, 34, 35, 161

[56] References Cited

U.S. PATENT DOCUMENTS

| | | | |
|---|---|---|---|
| 4,197,545 | 4/1980 | Favaloro et al. | 343/700 MS |
| 4,260,984 | 4/1981 | Saul | 333/35 |
| 4,283,694 | 8/1981 | Pzuker | 333/35 |
| 4,369,447 | 1/1983 | Edney | 343/700 MS |
| 4,415,900 | 11/1983 | Kaloi | 343/700 MS |

OTHER PUBLICATIONS

I.B.M. Technical Disclosure Bulletin, Vinding, J. P., vol. 8, No. 1, Jun., 1965.

IRE Convention Record, 1957, pp. 166–172, Rotman and Karas.

Microwave Journal, Aug., 1959, pp. 29–33, Rotman and Karas.

IEEE Trans. AP-19, No. 5, Sep. 1971, pp. 600–605, Green and Whitrow.

Int. Symposium Antennas and Propagation, Seattle, 1979, pp. 645–648, Hockham and Wolfson.

Second International Conference on Antennas and Propagation, York University, Apr. 13th–16th, 1981 (IEEE) Part 1, pp. 11–14.

Hockham and Wolfson IEEE Proceedings, vol. 132, Part H, No. 7, Dec. 1985, pp. 433–439, Shafai and Sebak.

1st European Microwave Conference, London, Sep. 1969, pp. 528–531, Graham and Dawson.

IEEE Trans. MTT-13, No. 5, Sep. 1965, pp. 676–692, Green.

*Primary Examiner*—William L. Sikes

*Assistant Examiner*—Doris J. Johnson

*Attorney, Agent, or Firm*—Fishman, Dionne & Cantor

[57] ABSTRACT

The antenna is adapted to be connected to a coaxial cable and includes a dielectric carrier board and a radiating element undulating longitudinally of the carrier board. The carrier board and radiating element are disposed in a conductive channel which has side walls adjacent the side edges of the carrier board. An input transition means is provided between the center conductor of the coaxial connector and the undulating track to provide a transition from the impedance of the coaxial cable to the impedance of the radiating element of the sandwich-wire antenna. When the antenna may, or may not, be connected to a coaxial cable, the side walls extend above the carrier board for such a height that the radiating aperture, which comprises the gap between the top edges of the side walls, presents a resistive load in the plane of the radiating element.

15 Claims, 2 Drawing Sheets

FIG. 1
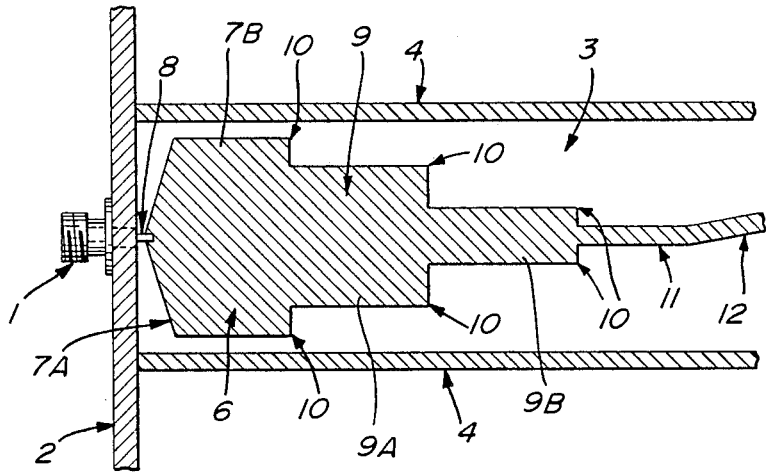
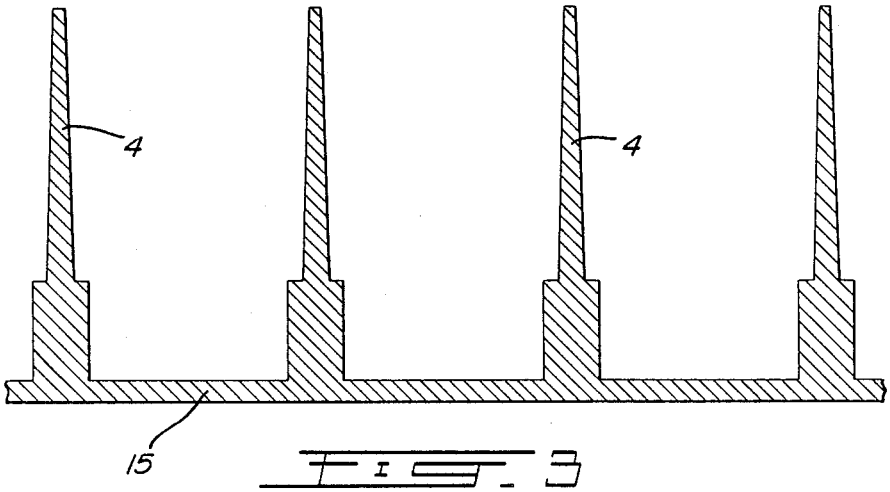
FIG. 3

SANDWICH-WIRE ANTENNA

BACKGROUND OF INVENTION

1. Field of the Invention

The invention relates to improvements in a sandwich-wire antenna. More specifically, the invention relates to a sandwich-wire antenna which includes improved input transition means. The invention also relates to a sandwich-wire antenna which is disposed in a metallic channel having side walls, the side walls extending above the height of the radiating element of the antenna. 2. Description of Prior Art The sandwich-wire antenna was first described by Rotman and Karas in IRE Convention Record, 1957, pp. 166–172 and in Microwave Journal, August 1959, pp. 29–33. In these publications, the sandwich-wire antenna was illustrated in the form of an undulating wire sandwiched between two straight wires. Hence the name of the antenna.

In this simplest form, the antenna radiates equally in two directions away from the plane of the wires and is therefore unsuitable for many applications where a single beam is required. Rotman and Karas recognize this in the same papers and therefore described several other implementations. In the most important of these, the two straight wires are replaced by an open rectangular metal channel or trough so that the antenna produces one beam which is directed substantially away from the channel. The undulating centre conductor may be formed from wire, or it may be printed as a flat metal track on a dielectric sheet. The height of the channel walls is normally chosen so that the edges are level with the centre conductor. This is a convenient arrangement for producing a planar array consisting of a number of sandwich-wire antennas. Several implementations of such an array have been built including the Doppler Navigation Antennas made by the applicant herein.

In cases when only a single linear antenna is required, the edges of the channel may be terminated with flanges or a horn flare to control the radiation pattern in the transverse plane.

Green and Whitrow IEEE Trans. AP-19, No. 5, September 1971, pp. 600–605, published a theoretical analysis of the sandwich-wire antenna in which they considered the possibility of extending the channel walls to a significant height above the plane of the centre conductor. This was done primarily for ease of mathematical modelling since part of their analysis treated the walls as extending to infinity although they also showed that certain choices of wall height are optimum in placing the aperture admittance of the channel in the correct phase relationship with the track radiation resistance so that wide-band operation may be obtained.

Hockham and Wolfson, Int. Symposium Antennas and Propagation, Seattle, 1979, pp. 645–648 and Second International conference on Antennas and Propagation, York University, 13th–16th April, 1981, (IEE) Part 1, pp. 11–14, described a sandwich-wire antenna which used thick walls projecting a small distance above the printed track. In this arrangement, the channel walls were in fact slotted waveguides, operating at a higher frequency band, so that the combination produced a dual-band antenna.

Shafai and Sebak, IEE Proceedings Vol. 132, Part H, No. 7, December 1985, pp. 433–439 have described a microstrip antenna, i.e., just using a printed dielectric sheet with a metal backing plate, but without any channels, where the use of the inverted track patterns on alternating tracks cancels cross-polarisation on the major axes of the antenna. However, in this arrangement, there will still be significant cross-polarisation away from the major axes, as the cancellation process does not operate completely in these areas.

Insofar as can be determined from the published literature, the methods of feeding sandwich-wire antennas have not been extensively investigated. In several cases, an antenna is fed by a simple coaxial connector at the input end. Another method, discussed by Graham and Dawson, 1st European Microwave Conference, London, September 1969, pp. 528–531, for a planar array of sandwich-wire antennas, is to project the centre conductors through the wall of a transverse waveguide to probe couple to the field in the waveguide.

Microstrip antennas are also known in the art as is illustrated in U.S. Pat. No. 4,197,545, Favaloro et al, Apr. 8, 1980, U.S. Pat. No. 4,369,447, Edney, Jan. 18, 1983, and U.S. Pat. No. 4,415,900, Kaloi, Nov. 15, 1983. However, none of these antennas are sandwich-wire-type antennas.

SUMMARY OF INVENTION

It is therefore an object of the invention to provide improvements for sandwich-wire antennas.

More specifically, it is an object of the invention to provide an improved input transition means for a sandwich-wire antenna.

It is a further object of the invention to provide for a sandwich-wire antenna disposed in a conductive channel having side walls, the improvement of having the side walls extend above the plane of the radiating element.

In accordance with the invention there is provided improvements to a sandwich-wire antenna which is adapted to be connected to a coaxial cable.

In accordance with one embodiment, input transition means provide a transition from the impedance of the coaxial cable to the impedance of the radiating element of the sandwich-wire antenna.

In accordance with a further embodiment, not necessarily to be connected to a coaxial cable, the radiating element is disposed in a channel having side walls, and the side walls, which are of equal height, extend above the radiating element for such a height that the radiating aperture which comprises the gap between the top edges of the side walls presents a resistive load in the plane of the radiating element.

BRIEF DESCRIPTION OF DRAWINGS

The invention will be better understood by an examination of the following description, together with the accompanying drawings, in which:

FIG. 1 is a top view of the input transition end of an antenna element, in accordance with the invention;

FIG. 3 shows one construction of channels for an array of sandwich-wire antennas in accordance with the invention.

DESCRIPTION OF PREFERRED EMBODIMENTS

Figure 2A:
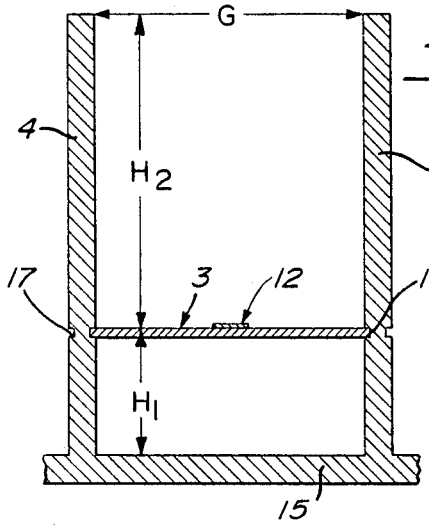
FIGS. 2A, 2B and 2C illustrate three different embodiments of the side walls of the channel.

Referring to FIG. 1, there is illustrated a view looking into the conductive channel forming the antenna at the input end of the antenna. Input transition means are illustrated in this figure and operation of this input transition will be considered in terms of a signal applied at the input to the antenna. However, since the input transition is reciprocal, a signal received by the sandwich-wire antenna will propagate along the antenna element through the transition into the coaxial cable. If the transition is well matched for signals applied at the input, then, by reciprocity, it will also be well matched for signals received by the antenna and travelling toward the transition.

An input signal from a coaxial cable (not shown) is applied at bulkhead coaxial cable connector 1 which is mounted on an end wall 2 of the antenna channel. The dielectric of the connector, which in some types of connector is enclosed in a concentric metal cylinder, projects through an opening in the wall, as shown in dotted lines, with the free end of the dielectric flush with the inner surface of the end wall. A track pattern of the transition and the sandwich-wire antenna is printed on a dielectric board 3 which is mounted between the channel walls 4 and held in position by grooves in the wall or by steps in the lower part of the channel as will be discussed with respect to FIGS. 2A, 2B and 2C.

There are two stages in the transition. The first part transforms from the impedance of the input cable and connector 1 to a section 6 of like impedance. In the case when the coaxial cable is a 50 ohm coaxial cable, this part of the transformer comprises a portion 7A, which flares outwardly in a direction away from the end wall 2 with a half-angle of 70–75 degrees, and a portion 7B which continues at a constant width. The total length of the section 6, which includes the portions 7A and 7B, is typically one-quarter wavelength long at mid-band of the frequency band of operation of the antenna (the mid-band frequency). This permits the fields to stabilize before the next stage of transition.

As the step in the outer conductor from the coaxial cable to the much larger section of the channel causes a capacitive mismatch, an inductive section is provided to compensate for this capacitive mismatch. Specifically, the left-hand end of the microstrip is spaced from the inner surface of the end wall 2 by a gap, and this gap is crossed by the centre conductor 8 of the coaxial cable to make contact, both physically and electrically, with the inner end of the microstrip. This gap also increases the clearance between the printed track and the channel end wall thus reducing the risk of high power breakdown.

The second stage of the transition consists of an impedance transformer illustrated generally at 9. An appropriate type is a double quarter-wave transformer with one quarter-wave transformer being identified at 9A and a second quarter-wave transformer being identified at 9B. However, other types of impedance transformers, such as linear taper, exponential taper or the Klopfenstein taper could be used instead. The required impedances for the intermediate sections of the transformers are calculated using the standard methods for matched quarter-wave impedance transformers. (See IRE Trans. MTT-7, April 1959, pp. 233–237). The quarter-wave is, once again, at the middle of the frequency band.

The track width for sections 7B, 9A and 9B can then be calculated using the results from finite difference computations to give the characteristic impedance and velocity of propagation, based on Green's paper, IEEE Trans. MTT-13, No. 5, September 1965, pp. 676–692. If the channel is stepped to support the board, as shown in FIGS. 2B and 2C, this step should be included in the geometry used for the finite difference computations. This step can make a significant difference to the results obtained for large track widths. The lengths of the transformer sections are chosen to be one quarter-wavelength long at the mid-band frequency calculated from the velocity of propagation of the quasi-TEM wave along the channel. Thus, in general, the two intermediate sections, 9A and 9B, will have different widths and slightly different lengths.

FIG. 1 shows the sections of the impedance transformer having sharp right-angled corners at 10. If desired, for ease of production of the printed circuit pattern, these sharp corners may be replaced by small chamfers or small radii, with negligible effect upon performance of the transformer.

The output of the transformer is to a narrow track 11, which is the main printed track along the antenna, and typically has a characteristic impedance in the range of 150–200 ohms. After a short straight length, the track pattern starts to undulate to form the radiating elements 12 of the antenna. All of the portions 7A, 7B, 9A, 9B and 11 are made of the same material as, and integral with, track 12.

The input transition provides a transformation from the TEM wave propagating along the coaxial cable, which typically has a characteristic impedance of 50 ohms, to a quasi-TEM wave propagating along the channel of the sandwich-wire antenna which has a much larger characteristic impedance, typically, as above-mentioned, in the range of 150–200 ohms. The wave along the channel would be purely TEM in the absence of the dielectric substrate 3. The presence of the dielectric perturbs the fields. These are no longer purely transverse because longitudinal components are necessary to satisfy the boundary conditions at the interfaces between the dielectric and free-space. In practice, the wave may be treated as quasi-TEM, neglecting the longitudinal field components, with very little error. The fields of this quasi-TEM wave tend to be concentrated more in the dielectric substrate than in the free-space regions.

Turning now to FIG. 2, there are illustrated three possible versions of the channel crosssection. The channel is designed to support the printed track at the correct height above the bottom of the channel, and to accurately position the track within the channel so that the correct radiation is produced from the antenna.

As seen, each of the channels includes the side walls 4 as well as a bottom wall 15. There are two heights to be selected, height $H_1$, the height from the bottom wall to the top of the dielectric board, and $H_2$, the height from the dielectric board to the top edge of the side walls. $H_1$ is chosen to be one-quarter free-space wavelength (at the midband frequency), less a correction for the slower propagation of TEM waves through the thickness of the dielectric board. The correction is given by:

$$T(\sqrt{\epsilon_r} - 1)$$

where T is the thickness of the dielectric board 3, and $\epsilon_r$ is its dielectric constant relative to free space.

The lower part of the channel, that is the space between the dielectric board and the bottom wall acts as a cavity, reinforcing radiation of signals propagating out of the channel.

Figure 2B:
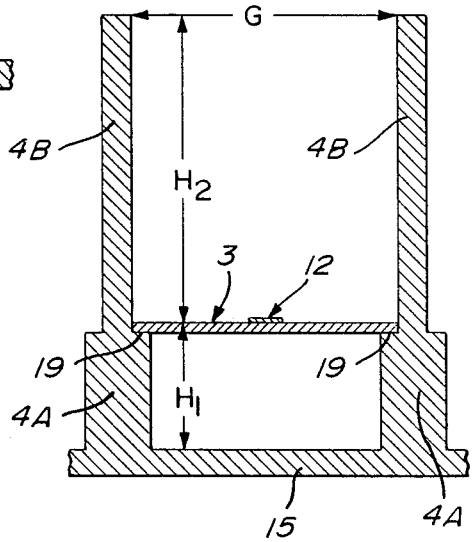
Figure 2C:
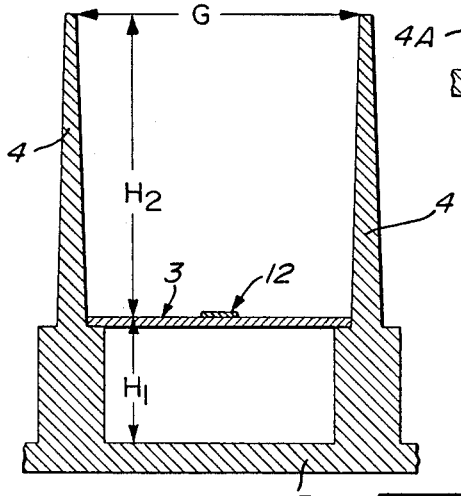

In the embodiment illustrated in FIG. 2A, the board is supported in grooves 17 in the sides of the side walls. Height $H_2$ should be selected such that the radiating aperture, which comprises the gap G between the top edges of the side walls presents a resistive load in the plane of the radiating element 12 and the recommended height $H_2$ is three-quarters of the free-space wavelength (at the mid-band frequency) less an end correction which defines the plane at which the aperture admittance appears resistive (as discussed in the paper by Green and Whitrow). The printed track 12 is shown as being on the upper side of the board. If, however, the board is mounted with the printed track on the lower side, the expressions for $H_1$ and $H_2$ are modified, as the correction for transmission through the dielectric board then applies to the spacing between the board and the top of the side walls. While this construction is good for experimental work and for small antennas, it is less appropriate for larger antennas because of the difficulty in fitting closely-toleranced dielectric boards into the grooves without causing damage to the edges of the boards.

In the version shown in FIG. 2B, the dielectric board 3 is supported by steps 19 of the side walls of the channel so that the portions of the wall **4*a* below the dielectric board are closer together than the portions 4*b* above the dielectric board. The board may be bonded to the steps to give a positive location. $H_1$ and $H_2$ are of the same order as $H_1$ and $H_2$ in FIG. 2A**. The reduced width of the channel below the board gives this cavity a lower impedance, but this will not affect the mid-band frequency performance of the antenna as the cavity is effectively an open circuit at the mid-band frequency.

In FIG. 2C, the tops of the side walls are shown as being slightly tapered. This allows the channel to be manufactured by extrusion when a small slope of the wall allows much better flow of metal improving the surface finish and strength of the extrusion.

The extension of the channel walls above the printed track gives several improvements to the design of the antenna. If the width of the channel is chosen to be less than one-half wavelength at the upper end of the frequency band, only the quasi-TEM wave will propagate along the channel, and only TEM waves can propagate out of the channel. Any transverse electric waves excited by the printed track are evanescent and will therefore be attenuated by this cut-off region. This reduces cross-polarised radiation from the antenna and prevents any radiation from the input transition. The use of high walls also reduces mutual coupling between channels of the antenna when used in an array configuration, eases computation of the propagation characteristics of the quasi-TEM wave as described above, and improves mechanical stiffness of the antenna.

The reduction of cross-polarisation within the individual radiating elements, rather than by cancellation using alternating adjacent elements (as described by Shafai and Sebak) has the advantage that cross-polarisation is reduced over all space, whereas cancellation operates primarily in the principal planes, with only partial reduction in the intervening spaces. Cancellation using alternating elements will also be less effective when adjacent elements do not have the same signal amplitudes as in a tapered illumination over an array aperture. Reducing cross-polarisation within the individual radiating elements is, however, equally effective for either uniform or tapered illuminations.

When an array of sandwich-wire antennas is required, a group of channels, as shown in FIG. 3, may be manufactured by extrusion. The width of extrusion will normally be limited by manufacturing capacity, but the section can be designed so that the extrusions may be clamped together to form a complete radiating structure.

The improvements illustrated in FIGS. 2A, 2B and 2C may be used with sandwich-wire antennas which are connected to coaxial cables or to other imput means, e.g., a waveguide probe input.

Although several embodiments have been described, this was for the purpose of illustrating, but not limiting, the invention. Various modifications, which will come readily to the mind of one skilled in the art, are within the scope of the invention as defined in the appended claims.

I claim:

1. In a sandwich-wire antenna adapted to be connected to a coaxial cable propagating a TEM wave and to operate over a frequency band, said antenna comprising:

a dielectric carrier board;

a radiating element mounted on said carrier board and comprising an undulating microstrip track extending longitudinally of said dielectric carrier board and propagating a quasi-TEM wave;

said carrier board with said radiating element being disposed in a conductive channel having side walls adjacent the side edges of said carrier board and said channel further including at least one end wall;

the improvement comprising:

input transition means for providing a transition from the impedance of said coaxial cable to the impedance of said radiating element of said sandwich-wire antenna, and for simultaneously providing a transformation from the TEM wave of the co-axial cable to the quasi-TEM wave of said radiating element, said input transition means being formed integrally with and of the same material as the material of said microstrip track.

2. The antenna of claim 1 and including a connector on said coaxial cable for connecting said coaxial cable to said radiating element;

said connector having a centre conductor;

said input transition means being disposed, both physically and electrically, between said centre conductor and said radiating element.

3. The antenna of claim 2 and including means on said end wall for receiving said connector;

said centre conductor extending through said end wall onto said carrier board to make physical and electrical contact with one end of said input transition means.

4. The antenna of claim 3 wherein said input transition means comprises:

a. a transformer means for transforming the impedance of the coaxial cable to a like impedance of a section of said microtrip material at said one end of said input transition means and for providing said transformation from the TEM wave of the co-axial cable to the quasi-TEM wave of said radiating element, whereby said transformation is provided while maintaining substantially constant impedance; and b. impedance transformer means.

5. The antenna of claim 4 wherein said transformer means comprises a first section comprising microstrip flaring outwardly in the direction away from said one end, and a second section of constant width, the length of said first and second sections being substantially one quarter-wave length at the middle of said frequency band.

6. The antenna of claim 5 wherein said impedance transformer comprises two quarter-wave transformers each being one quarter-wavelength at the middle of said frequency band.

7. The antenna of claim 6 wherein said one end is spaced from the inner surface of said end wall by a gap;

said centre conductor extending across said gap to contact said one end.

8. A sandwich-wire antenna adapted to operate over a frequency band, said antenna comprising:

a dielectric carrier board;

a radiating element mounted on said carrier board and comprising an undulating microstrip track extending longitudinally of said dielectric carrier board;

said carrier board with said radiating element being disposed in a conductive channel having spaced side walls adjacent the side edges of said carrier board and said channel further including at least one end wall;

the improvement comprising:

said side walls being of equal height and extending above said carrier board for such a height that the radiating aperture, comprising the gap between the top edges of the side walls, presents a resistive load in the plane of the radiating element;

means on said side walls above said bottom wall for supporting said carrier board;

wherein, said radiating element is spaced from said bottom wall by a first height; and wherein said radiating element is spaced from the top edges of said walls by a second height;

said second height being greater than said first height.

9. The antenna of claim 8 wherein said first height is substantially one quarter-wavelength in the middle of the frequency band; and wherein said second height is substantially three quarter-wavelengths in the middle of said frequency band.

10. The antenna of claim 9 wherein said means for supporting a carrier board comprises grooves in said side walls;

a respective one of the edges of said carrier board extending into a respective one of said grooves.

11. The antenna of claim 9 wherein said means for supporting comprises a step in said side walls, a respective one of said edges of said board resting on a respective one of said steps.

12. The antenna of claim 11 wherein said board is bonded to the top surfaces of said steps.

13. The antenna of claim 12 wherein said side walls taper upwardly from said steps.

14. The antenna of claim 10 wherein the spacing of said side walls is less than one-half wavelength to thereby suppress cross-polarized radiation from the antenna.

15. In a sandwich-wire antenna adapted to be connected to a coaxial cable and to operate over a frequency band, said antenna comprising:

a dielectric carrier board;

a radiating element mounted on said carrier board and comprising an undulating microstrip track extending longitudinally of said dielectric carrier board;

said carrier board with said radiating element being disposed in a conductive channel having side walls adjacent the side edges of said carrier board and said channel further including at least one end wall;

the improvement comprising:

input transition means for providing a transition from the impedance of said coaxial cable to the impedance of said radiating element of said sandwich-wire antenna, said input transition means being formed integrally with and of the same material as the material of said microstrip track;

and the further improvement comprising:

said side walls being of equal height and extending above said carrier board for such a height that the radiating aperture, comprising the gap between the top edges of the side walls, presents a resistive load in the plane of the radiating element.

* * * * *

UNITED STATES PATENT AND TRADEMARK OFFICE

CERTIFICATE OF CORRECTION

PATENT NO. : 4,760,400

DATED : July 26, 1988

INVENTOR(S) : ANDREW J. LAIT

It is certified that error appears in the above-identified patent and that said Letters Patent is hereby corrected as shown below:

On the Title Page:

References cited, U.S. Patent Documents, line 2, change "4,206,984" to --4,260,964--.

References cited, U.S. Patent Documents, line 3, change "Pzuker" to --Panker--.

Column 1, line 13, move heading "2. Description of Prior Art" to the next independent line.

Column 1, line 59, change "conference" to --Conference--.

Column 6, line 19, change "imput" to --input--.

Column 6, line 47, change "co-axial" to --coaxial--.

Column 7, line 3, change "co-axial" to --coaxial--.

Claim 10, line 1, change "9" to --14--.

Claim 11, line 1, change "9" to --14--.

Claim 14, line 1, change "10" to --9--.

Signed and Sealed this

Seventh Day of November, 1989

*Attest:*

JEFFREY M. SAMUELS

*Attesting Officer*

*Acting Commissioner of Patents and Trademarks*